US005146770A

United States Patent [19]

Yun-Sheng

[11] Patent Number: 5,146,770

[45] Date of Patent: Sep. 15, 1992

[54] CARD-OPERATED LOCK

[76] Inventor: Chung Yun-Sheng, No. 5, Chung Chyau 2 Street, Dah Lii Country, Taichung Hsien, Taiwan

[21] Appl. No.: 766,512

[22] Filed: Sep. 27, 1991

[51] Int. Cl.[5] ..... E05B 67/22; E05B 35/04

[52] U.S. Cl. ..... 70/38 C; 70/387; 70/405; 70/409

[58] Field of Search ..... 70/35, 38-39, 70/371, 387, 405, 407, 409, 411

[56] References Cited

U.S. PATENT DOCUMENTS

| | | | |
|---|---|---|---|
| 1,458,520 | 6/1923 | Castell | 70/409 X |
| 1,462,869 | 7/1923 | Primak | 70/38 B |
| 1,540,488 | 6/1925 | Mataloni | 70/38 C |
| 1,719,309 | 7/1929 | Radosevic | 70/38 C |
| 2,985,005 | 5/1961 | Kahn | 70/38 C X |
| 3,588,397 | 6/1971 | Ellefson | 70/387 X |
| 4,111,018 | 9/1978 | Pilvet | 70/387 X |
| 4,149,394 | 4/1979 | Sornes | 70/387 X |
| 4,838,058 | 6/1989 | Matsumoto | 70/387 X |
| 4,860,562 | 8/1989 | Koren et al. | 70/371 X |
| 5,024,071 | 6/1991 | Shafirkin | 70/387 |
| 5,025,647 | 6/1991 | Muus | 70/387 X |

*Primary Examiner*—Renee S. Luebke
*Assistant Examiner*—Suzanne L. Dino
*Attorney, Agent, or Firm*—Lowe, Price, LeBlanc & Becker

[57] ABSTRACT

A card-operated lock using a card with embossed letters matching with corresponding letters on letter profiles in the lock for lowering of side levers on the letter profiles and consequently disengaging the letter profiles from their retaining plates to open the lock. The lock is designed to prevent opening thereof without the designated card.

3 Claims, 7 Drawing Sheets

FIG.3 (A)
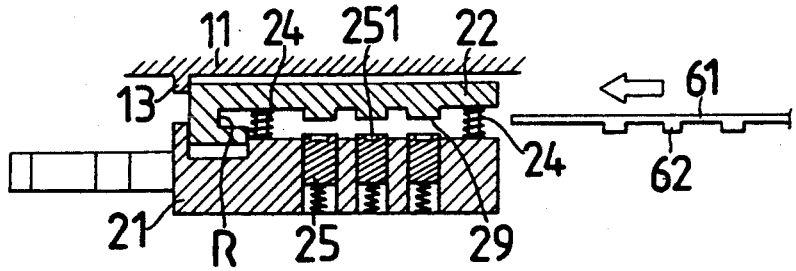
FIG.3(B)
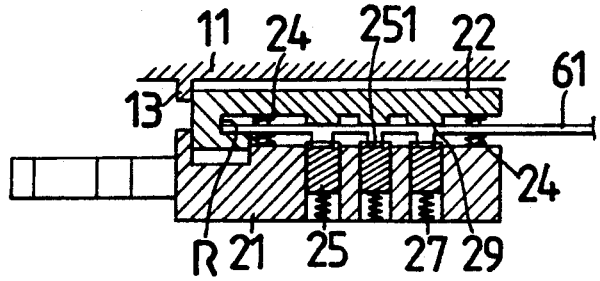
FIG.3(C)
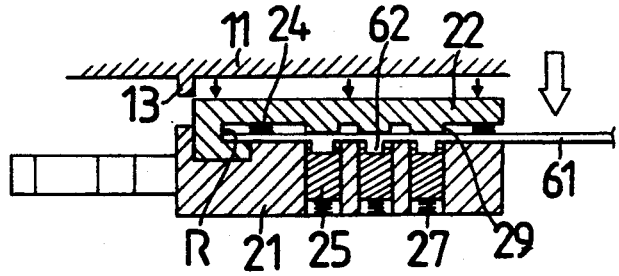
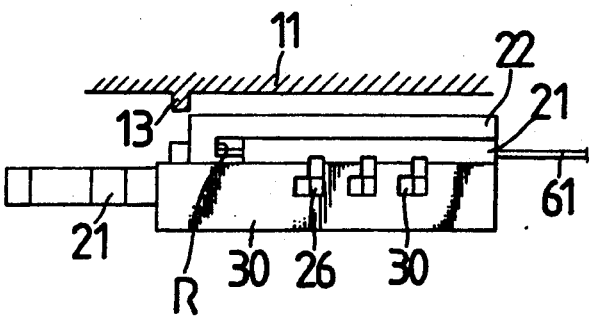
FIG.3(D)
FIG.3(E)
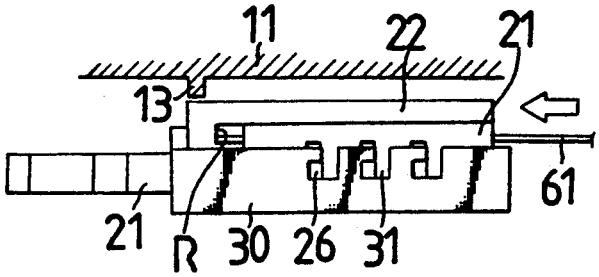

CARD-OPERATED LOCK

BACKGROUND OF THE INVENTION

The present invention relates to a card-operated lock, and in particular to a lock using a card with embossed letters matching with corresponding letters on letter profiles for lowering side levers and consequently for disengaging the letter profiles from their retaining plates to open the lock. This invention is designed to prevent opening of a lock without the designated card.

Today women who used to take care of homes are employed outside the home, and hence often nobody is at home during office hours. This then has become a good time for thefts. Such a burglary or theft not only causes loss of property but psychological injury to the victims can occur also. Such theft is mainly caused by the lack of reliable locks, and the fact that conventional locks can usually be opened by common tools. Therefore, home security is a primary concern. The lack of basic theft-proof facilities has become a public problem.

In view of the above problem, the Inventor has created a card-operated lock to provide a reliable lock which can not be opened by any tool other than the designated card.

SUMMARY OF THE INVENTION

The main objective of the present invention is to provide a card-operated lock using a card with embossed letters which match corresponding letters on letter profiles in the lock for lowering levers therein and consequently disengaging the letter profiles from their retaining plates to open the lock. The lock of this invention can not be opened without the designated card.

BRIEF DESCRIPTION OF THE DRAWINGS

FIGS. 3 (A)-(E) are sequential side sectional views illustrating operation of the card-operated lock according to the present invention as the card is inserted.

DETAILED DESCRIPTION OF THE PREFERRED EMBODIMENT

Figure 1:
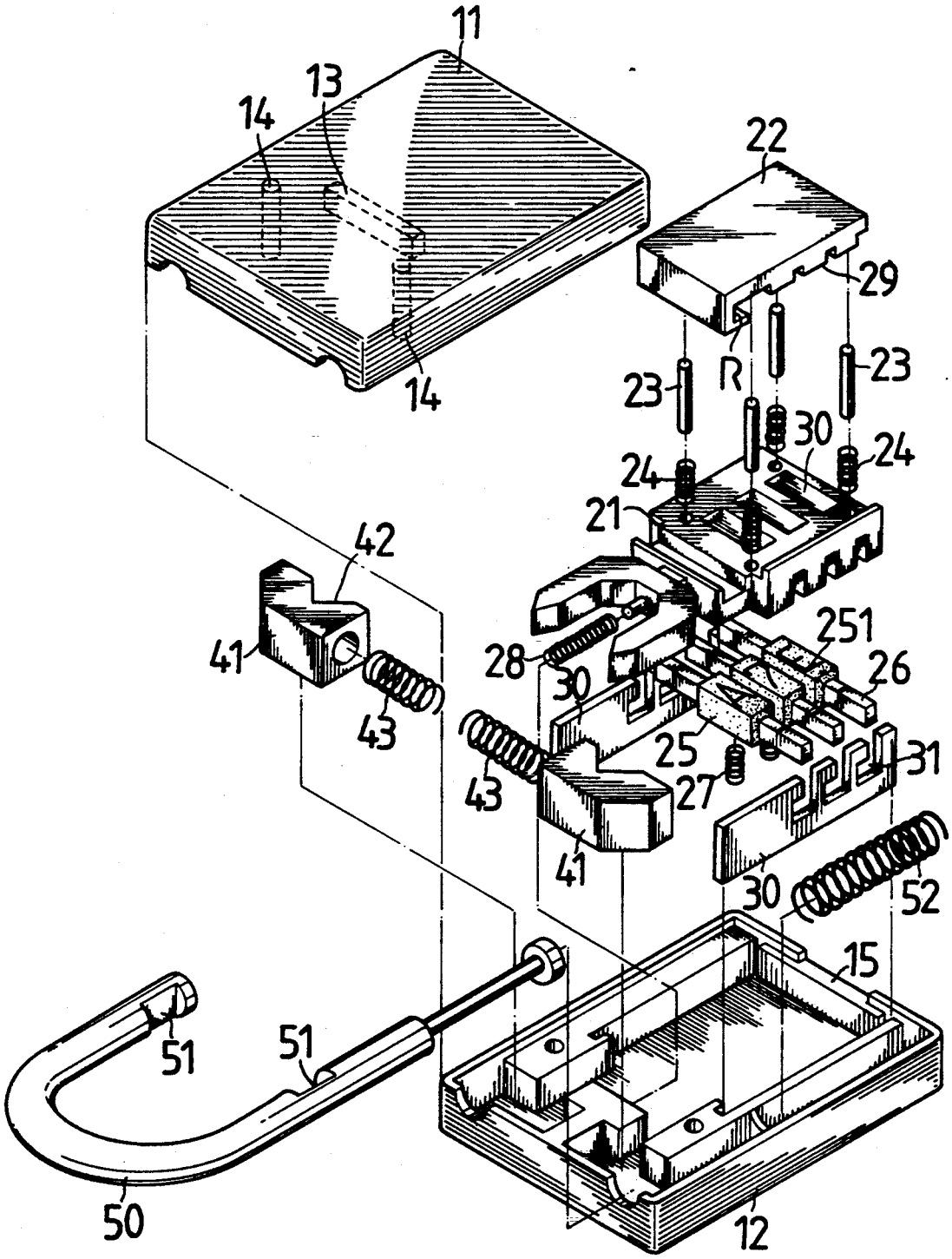
FIG. 1 is an exploded view of a card-operated lock according to the present invention.
Figure 2:
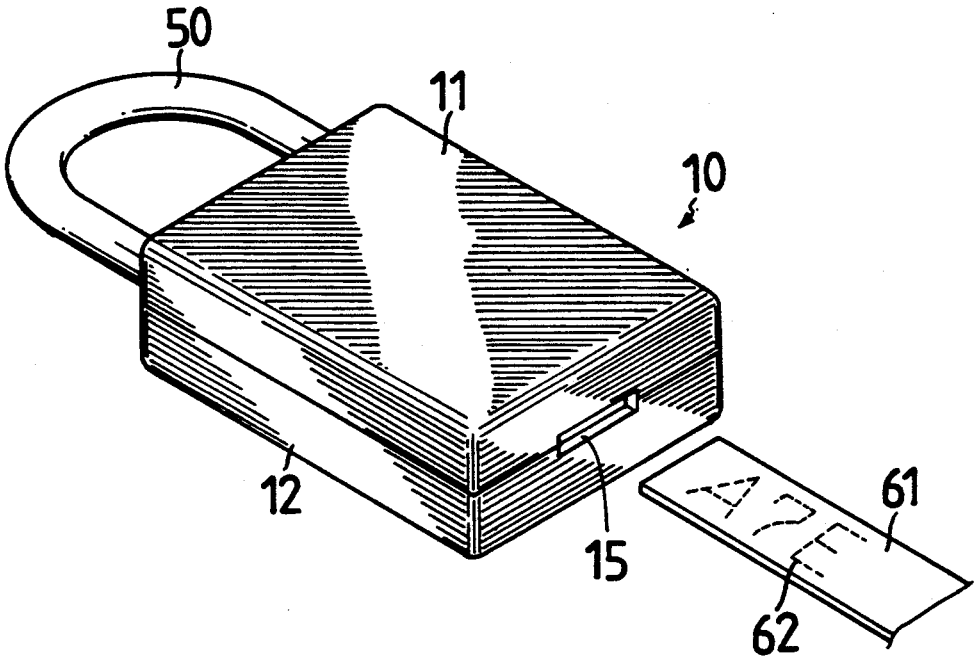
FIG. 2 is a perspective view of the card-operated lock and card assembled according to the present invention.

The card-operate lock (10) according to the present invention includes a sliding block (21) with a sliding plate (22), and a set of letter profiles (25) which are matched precisely so that no tool other than a particularly designed card can open the lock. Lock (10) also has upper and lower housing members (11) and (12) and a shackle (50).

FIG. 3 illustrates the relationship between card (61) and lock (10) according to the present invention. When the card (61) is inserted into a card inserting slot (15) at the back of the lock (10), its front end abuts sliding plate (22), which in turn abuts point R on upper lock portion (11). Card (61) gets contacts three internal blocks (29) beneath the sliding plate (22) so that a plurality of, for example, three embossed letters (62) on the card (61) can contact their corresponding letter profiles (25) evenly. When the embossed letters (62) on the card (61) match the engraved letters (251) on the letter profiles (25), the card (61) can be pressed downwardly slightly so that the sliding plate (22) is displaced downwardly by the front edge of the card (61) retained by the point R at the sliding plate (22). Consequently, when the engraved letters (251) are filled by the embossed letters (62), depressing card (61) causes the letter profiles (25) to depress side levers (26) at both sides of the letter profiles (25) into their corresponding chambers (31) in retaining plates (30), respectively, and sliding plate (22) is lowered until its front edge is lower than a stop element (13) at on upper housing (11). The sliding block (21) can then be moved farther.

Figure 4A:
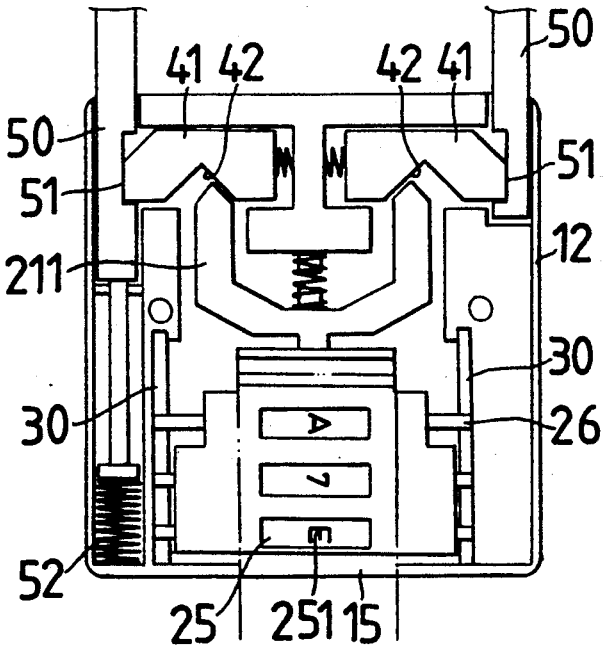
FIGS. 4 (A) and (B) are top sectional views illustrating operation of the card-operated lock according to the present invention wherein insertion of the card frees the lock shackle.
Figure 4B:
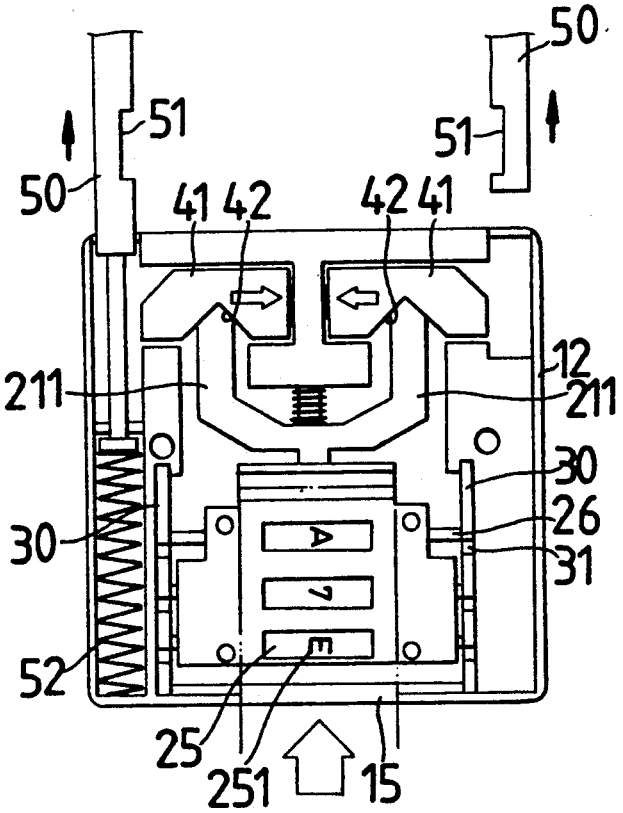

As shown in FIG. 4, when the sliding block (21) is moved forward, its front fork (211) pushes slant surface (42) on each of two sliding pieces (41) so that its longitudinal thrust is converted to traverse thrust by its movement on the slant surface (42). Hence, the two sliding pieces (41) which retain a shackle (50) at two side retaining notches (51) are retracted and disengaged from the retaining notches (51). The shackle (50) is then forced to move by compression spring (52), and the lock is opened.

Figure 5A:
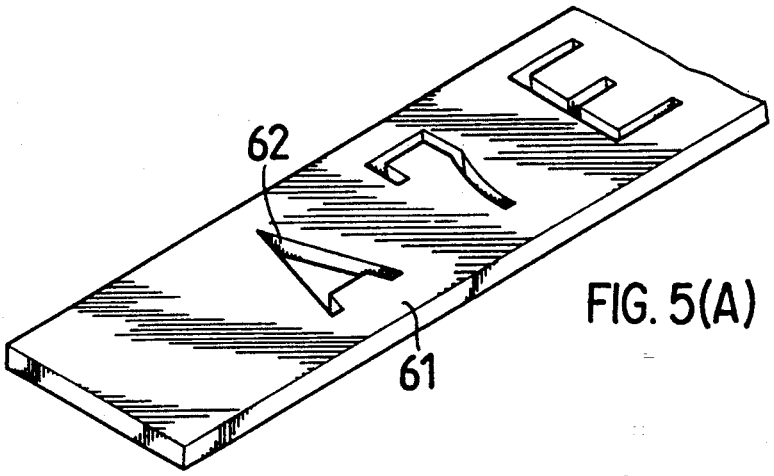
FIGS. 5 (A) and (B) are perspective views of another embodiment of card-operated lock according to the present invention.
Figure 5B:
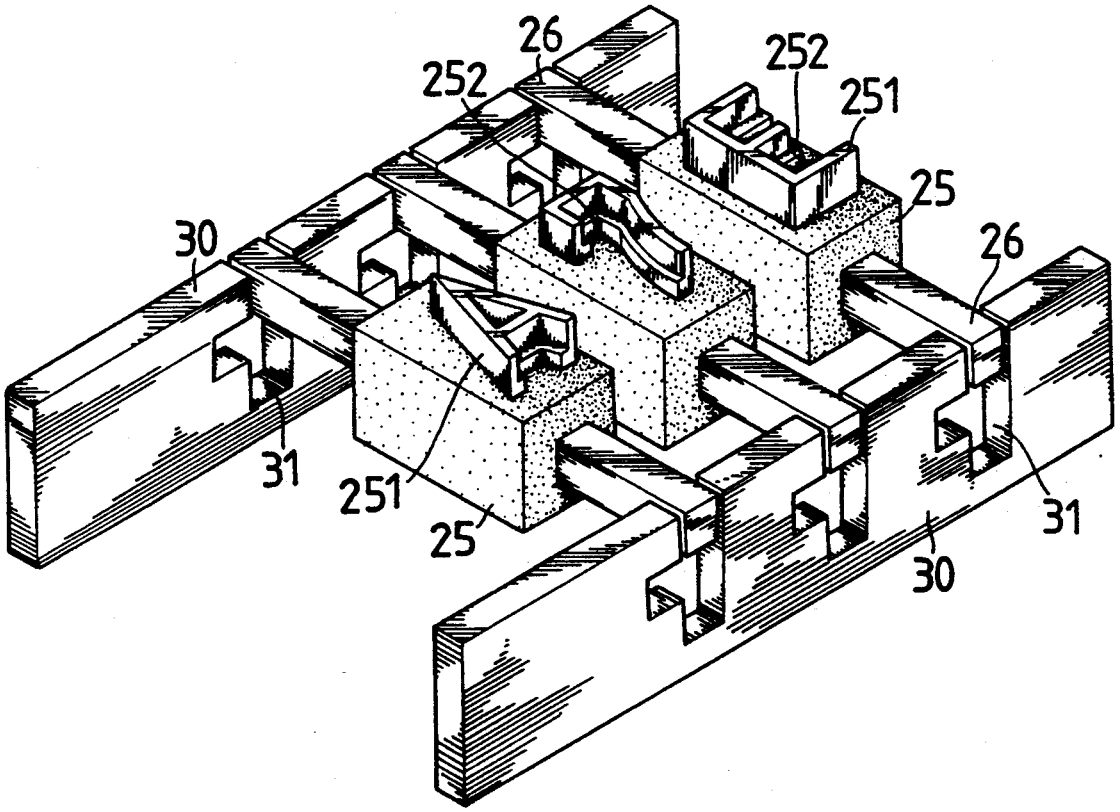
Figure 6A:
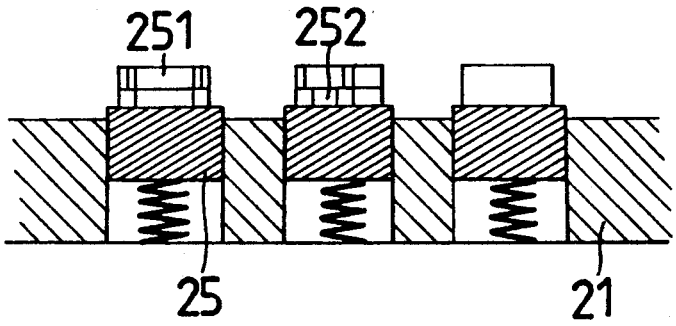
FIGS. 6 (A) and (B) illustrate sequential operation of the card-operated lock embodiment of FIGS. 5 (A) and (B) according to the present invention.
Figure 6B:
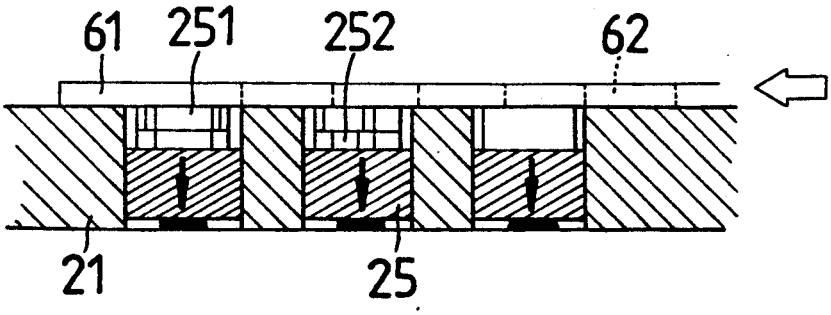
Figure 7A:
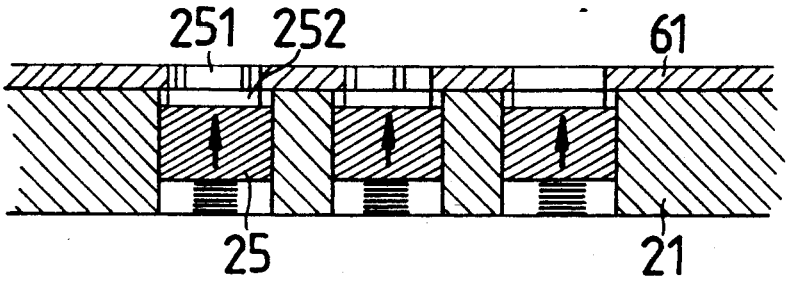
FIGS. 7 (A)-(C) illustrate further sequential operation of the embodiment of card-operated lock of FIGS. 5 (A) and (B) according to the present invention.
Figure 7B:
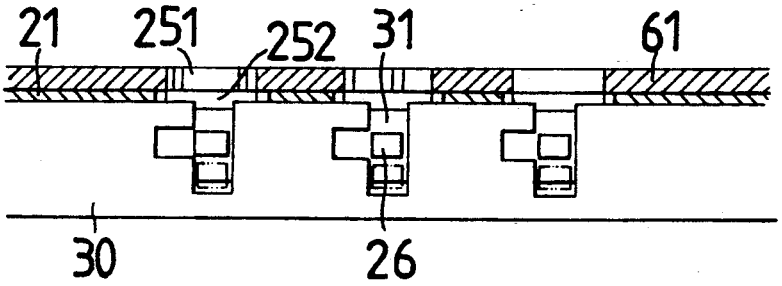
Figure 7C:
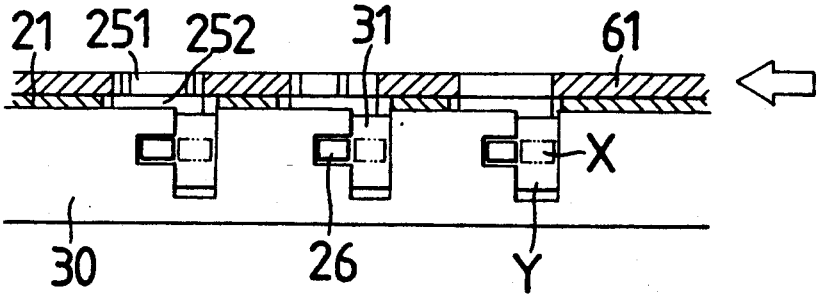

FIG. 5 shows an alternative embodiment for the letter profiles (25) and the retaining plates (30). Due to changes in the shapes of the card (61), the letter profiles (25) and the retaining plates (30), use of the sliding plate (22) with its supporting posts (23) and springs (24) can be eliminated. As shown in FIGS. 6 and 7, after the card (61) with hollow letters (62) is inserted into the card inserting slot (15), the letter profiles (25) are depressed for a depth equal to the height of a upper stepped portion (252) of such embossed letters (251) on the letter profiles (25). Each side lever (26) then reaches the position Y in the chamber (31). Then, if the card (61) is pushed forward further, the embossed letters (251) on the letter profiles (25) will pop up into their corresponding hollow letters (62) on the card (61) until the uppers stepped portions (252) reach the card (61). The side levers (26) are located at the position X of the chambers (31). Consequently, the sliding block (21) can be pushed forward to open the lock. This design then which can prevent opening of; the lock by any tool other than the designated card.

I claim:

1. A card-operated lock comprising:

a lock body having upper and lower housing members, a slot for inserting a card therebetween and a releasable shackle; said housing members enclosing a sliding block and a sliding plate mounted thereover, said block having three bottom blocks therein, and a front fork mounted thereon;

three letter profiles formed on the upper surface of said three bottom blocks each having an embossed or engraved letter thereon and a side lever mounted at each lateral side of each bottom block;

two retaining plates mounted on either side of said sliding block each having three chambers receiving said side levers of said bottom blocks;

shackle retaining means including two sliding pieces each having a notch with V-shaped slant surfaces and a compression spring mounted within the lock body registering in on the front fork for releasably holding said shackle; and a card in the form of a rectangular strip having three embossed or hollow letters corresponding to the letters on the letter profiles whereby insertion of the card will match the letters thereon in the profiles so that the block may be moved forward whereby the front fork engages the slant surfaces to release the shackle by urging said sliding pieces together.

2. The card-operated lock of claim 1 wherein said letter profiles on the bottom blocks match with letters on the card and are consequently depressed so that the side levers are disengaged from the retaining plates for movement of the sliding block to release said shackle.

3. The card-operated lock of claim 1 wherein said retaining means comprises means for causing the front fork on the sliding block to engage the slant surfaces on the two sliding pieces when the sliding block is pushed forward to convert longitudinal thrust of the block to lateral thrust so that the sliding pieces are retracted to release the shackle and whereby when the sliding pieces are not subject to said thrust the compression spring will displace them laterally outwardly to retain said shackle in said lock body.

* * * * *